US010089877B2

(12) United States Patent
Offenhaeuser et al.

(10) Patent No.: US 10,089,877 B2
(45) Date of Patent: Oct. 2, 2018

(54) METHOD AND DEVICE FOR WARNING OTHER ROAD USERS IN RESPONSE TO A VEHICLE TRAVELING IN THE WRONG DIRECTION

(71) Applicant: Robert Bosch GmbH, Stuttgart (DE)

(72) Inventors: Andreas Offenhaeuser, Marbach am Neckar (DE); Werner Poechmueller, Hildesheim (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 15/742,362

(22) PCT Filed: May 23, 2016

(86) PCT No.: PCT/EP2016/061588
§ 371 (c)(1),
(2) Date: Jan. 5, 2018

(87) PCT Pub. No.: WO2017/012742
PCT Pub. Date: Jan. 26, 2017

(65) Prior Publication Data

US 2018/0218608 A1 Aug. 2, 2018

(30) Foreign Application Priority Data

Jul. 17, 2015 (DE) ..... 10 2015 213 517

(51) Int. Cl.
*G08G 1/09* (2006.01)
*G08G 1/16* (2006.01)
*G08G 1/056* (2006.01)

(52) U.S. Cl.
CPC ..... *G08G 1/162* (2013.01); *G08G 1/056* (2013.01)

(58) Field of Classification Search
CPC ..... G08G 1/056; G08G 1/164; G08G 1/166; B60Q 9/008
See application file for complete search history.

(56) References Cited

U.S. PATENT DOCUMENTS

2005/0171694 A1* 8/2005 Schirmer ..... G01C 21/3626 701/411
2010/0261428 A1* 10/2010 Goto ..... G07B 15/063 455/41.2

(Continued)

FOREIGN PATENT DOCUMENTS

DE 10334203 A1 3/2005
DE 102010003429 A1 10/2011

(Continued)

OTHER PUBLICATIONS

International Search Report dated Jul. 14, 2016, of the corresponding International Application PCT/EP2016/061588 filed May 23, 2016.

*Primary Examiner* — Omeed Alizada
(74) *Attorney, Agent, or Firm* — Norton Rose Fulbright US LLP; Gerard Messina

(57) ABSTRACT

A method for warning other road users in response to a vehicle traveling in a wrong direction, the method including advance detection, setting-up, detection, and provision. In the step of advance detection, a potential of a possible instance of wrong-way travel of the vehicle is detected in advance. In the step of setting-up, a communication path to at least one road user endangered by the instance of wrong-way travel is set up, if the wrong-way travel potential is greater than an advance warning value. In the step of detection, the instance of wrong-way travel of the vehicle is detected. In the step of provision, an information item about the instance of wrong-way travel is provided for the endangered road user via the communication path set up, when the (Continued)

possible instance of wrong-way travel is detected as an actual instance of wrong-way travel.

9 Claims, 2 Drawing Sheets

(56) References Cited

U.S. PATENT DOCUMENTS

2012/0286974 A1 11/2012 Claussen et al.
2015/0112590 A1* 4/2015 Fureder ..... G08G 1/163
701/522

FOREIGN PATENT DOCUMENTS

DE 102014208662 A1 3/2015
DE 102013224167 A1 5/2015

* cited by examiner

METHOD AND DEVICE FOR WARNING OTHER ROAD USERS IN RESPONSE TO A VEHICLE TRAVELING IN THE WRONG DIRECTION

BACKGROUND INFORMATION

The present invention relates to a device, a method, and a computer program.

In the case of an accident, wrong-way drivers, who are also referred to as ghost drivers, cause deaths, injuries and considerable property damage. Over half of the instances of wrong-way travel begin on junctions to federal expressways, and/or highways having divided directional lanes. In particular, instances of wrong-way travel on expressways result in accidents at a high collision speed and, consequently, frequently result in injuries resulting in death.

Wrong-way drivers may be detected in different manners. For example, video sensor technology may be used to detect the passing of a "Do Not Enter" sign. A digital map in conjunction with a navigation system may equally be used for detecting a wrong direction of travel on a section of a route, which may be traveled on in only one direction. Furthermore, wireless methods may be used, which detect wrong-way drivers with the aid of infrastructure, such as beacons in the roadway or on the edge of the roadway.

SUMMARY

In accordance with the present invention, a method is provided for warning other road users in the event of a vehicle traveling in the wrong direction, in addition, a device that applies this method, and a corresponding computer program are also provided. Advantageous further refinements and improvements of the device are rendered possible by the measures described herein.

Reliable detection of an instance of wrong-way travel requires time. During this time, the vehicle traveling the wrong way is already moving counter to the direction of travel, and a serious collision with another road user may result. In addition, setting up communication with other road users requires more time, during which the wrong-way vehicle moves counter to the direction of travel. Thus, up to now, too much time elapses until other road users may be warned.

In order to shorten the time until a warning, the approach introduced here provides for the setting-up of communication to already be started, if there is a certain possibility of wrong-way travel. In this context, communication is set up, although it is not yet certain whether an instance of traveling in the wrong direction will actually occur. If the instance of wrong-way travel is then identified with a high degree of certainty, a warning of the wrong-way driver may be transmitted, with a minimal delay, via the communication already set up.

A method for warning other road users when a vehicle is traveling in the wrong direction is put forward, the method including the following steps:

detecting in advance a wrong-way travel potential of a possible instance of wrong-way travel of the vehicle;

setting up a communication path to at least one road user put at risk by the instance of wrong-way travel, if the wrong-way travel potential is greater than an advance warning value;

detecting the instance of wrong-way travel of the vehicle; and providing an information item about a wrong-way driver for the endangered road user via the communication path set up, if the possible instance of wrong-way travel is detected as an actual instance of wrong-way travel.

An instance of wrong-way travel may be understood as a trip of a vehicle in a direction counter to an intended direction of travel on a road having separated directional lanes. In the same manner, an instance of wrong-way travel may take place in a direction opposite to a one-way street, against the direction of travel of an exit ramp, or against the direction of travel of a traffic circle. Another road user may be a driver of another vehicle. A potential for wrong-way travel may exist, for example, at a location, at which two lanes previously running in the same direction are spatially separated with opposing directions of travel. For example, the wrong-way travel potential is recognized as elevated, if the vehicle changes lanes to the opposite lane shortly before such a location. In this context, a distinction may be made between an evasive maneuver in front of an obstacle in one's own lane and a lane change made deliberately.

In order to set up a communication path, for example, a request for a communication path may be sent by a communications device of the vehicle to a mobile radio network cell connected at the moment. The potential for wrong-way travel may equally be determined by a permanently installed detection device. The request may then be transmitted by the detection device to the radio cell. Starting from the radio cell, other communications devices in other vehicles, connected to the radio cell and/or adjacent radio cells, may be asked to set up a silent communication. Consequently, the communication path between the communications device or the detection device, the radio cell, and at least one other communications device is opened, although no further information is outputted by the further communications device to drivers of the further vehicles, up to a point in time of a definitive detection of an instance of wrong-way travel.

If the instance of wrong-way travel is detected, a warning information item may be provided rapidly via the communication path already set up. The communication path may be regarded as a communication channel. Alternatively, in the setting-up step, a communication channel running through the communication path may additionally be set up.

The potential for wrong-way travel and/or the actual instance of wrong-way travel may be determined, using a comparison between an ascertained vehicle position of the vehicle and, additionally or alternatively, a movement trajectory of the vehicle and map data. The vehicle position and/or the movement trajectory may be ascertained, for example, using a position determination system. In many vehicles, the equipment necessary to make this comparison is already present. Consequently, the starting point put forward here may simply be retrofitted.

The movement trajectory may be predicted into the future, using at least one filter. A short reaction time in the context of the advance detection of the wrong-way travel potential and/or the detection of the actual instance of wrong-way travel may be achieved, using a prediction.

The movement trajectory may be determined, using a vehicle motion model of the vehicle and, additionally or alternatively, an inertial sensor system of the vehicle. Using a movement trajectory based on an inertial sensor system, the potential for wrong-way travel and/or the instance of wrong-way travel may be detected accurately. Signals of a position determination system may be validated by it.

The wrong-way travel potential and/or the actual instance of wrong-way travel may be determined, using a surround sensor system of the vehicle. A surround sensor system may include, for example, a camera system, which detects and evaluates traffic signs and/or roadway markings. Consequently, the instance of wrong-way travel may be detected immediately in response to the passing of at least a traffic sign and/or a roadway marking.

The wrong-way travel potential and the actual instance of wrong-way travel may be determined, using the same detection method. In this manner, processor capacity may be saved.

The method may include a removal step, in which the communication path is removed when the wrong-way travel potential is detected to be less than the advance warning value and/or no actual instance of wrong-way travel is detected. In this manner, utilization of the communications network may be decreased, and consequently, costs may be reduced.

In the setting-up step, a recording may be started, if the wrong-way travel potential is greater than the advance warning value. Simple preservation of evidence may take place by recording relevant data of the vehicle and/or via a video recording.

This method may be implemented, for example, as software or hardware, or in a combined form of software and hardware, in, for example, a control unit.

A method for detecting a person driving in the wrong direction and warning other road users in his/her vicinity may be characterized in that the detection of the wrong-way driver includes a rapid, but less reliable advance detection and a further, reliable, final detection; after the advance detection, "preventive" communication with vehicles in the vicinity of the wrong-way driver being set up, via which a warning message is transmitted after the final detection.

The advance detection and the final detection may be based on the same detection method.

The advance detection and the final detection may be based on the comparison of a movement trajectory to a section of a digital map.

The advance detection and the final detection may be based on different methods, for example, on detection of a traffic sign and a comparison of a movement trajectory to a section of a digital map.

An inertial sensor system may be used in conjunction with a vehicle motion model to express a temporally high-resolution movement trajectory.

A movement trajectory, which is based on GPS and is predicted into the future with the aid of inertial sensor technology and by application of filters, may be used for the advance detection.

The inertial sensor system of a smart phone may be used, and the sensors may be calibrated to it by way of constant monitoring of the smart phone by the server.

In addition to the preventive communication, further functions, such as an accident camera, may also be activated.

The present invention further provides a system which is configured to perform, control and/or implement the steps of a variant of a method described herein, in corresponding devices.

The object of the present invention may also be achieved quickly and efficiently by this embodiment variant of the present invention, in the form of a system.

In the case at hand, a system may be understood as electrical devices, which process sensor signals and output control and/or data signals as a function of them. The system may have interfaces, which may be implemented as hardware and/or software. In a hardware design, the interfaces may, for example, be part of so-called system ASIC's that include many different functions of the system. However, it is also possible for the interfaces to be separate, integrated circuits or to be at least partially made up of discrete components. In a software design, the interfaces may be software modules that are present on a microcontroller in addition to other software modules, for example. The system may be constructed of spatially separated, individual components.

Also advantageous is a computer program product or computer program, including program code, which may be stored on a machine-readable carrier or storage medium, such as a solid state memory, a hard disk storage device or an optical storage device, and is used for performing, implementing and/or controlling the steps of the method according to one of the above-described specific embodiments, in particular, when the program product or program is executed on a computer or a device.

Exemplary embodiments of the present invention are shown in the figures and explained in greater detail below.

DETAILED DESCRIPTION OF EXAMPLE EMBODIMENTS

Figure 1:
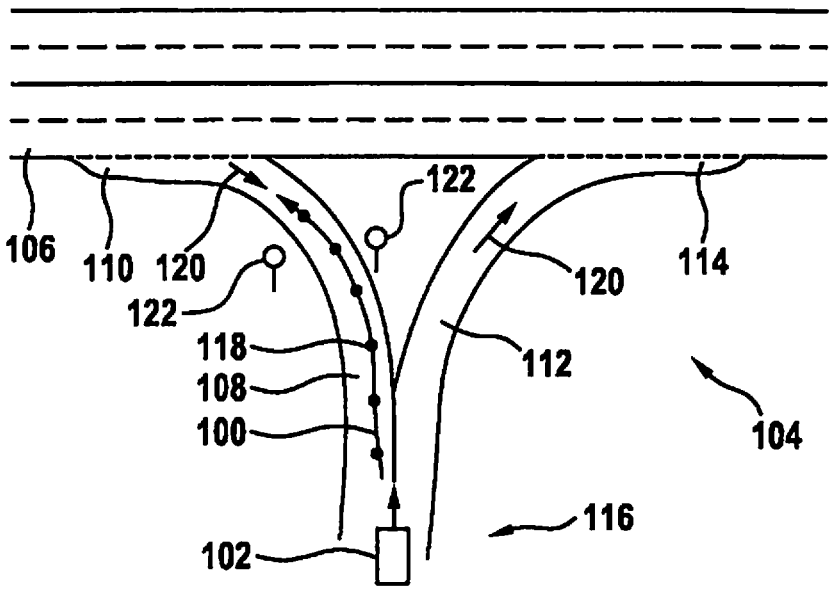
FIG. 1 shows a view of a movement trajectory of a person driving in the wrong direction at the junction of an expressway.

In the description below of preferred exemplary embodiments of the present invention, the same or similar reference numerals are used for the elements that are shown in the various figures and function similarly, in which case a repeated description of these elements is omitted.

FIG. 1 shows a view of a movement trajectory 100 of a vehicle 102 traveling in the wrong direction at a junction 104 of an expressway 106. Expressway 106 includes two separate sides having two lanes per direction of travel. Here, junction 104 is only partially shown. An exit ramp 108 having a deceleration lane 110, as well as an entrance ramp 112 having an acceleration lane 114, are shown. Exit ramp 108 and entrance ramp 112 run parallel to one another in a feeder area 116 and form, there, a common roadway having two lanes running in opposite directions.

Feeder area 116 is oriented perpendicularly to expressway 106. Outside of feeder area 116, the lanes of ramps 108, 112 separate and run curvilinearly to expressway 106, until they transition approximately tangentially to expressway 106 in deceleration lane 110 and acceleration lane 114, respectively.

Vehicle 102 is shown in feeder area 116 and travels in the direction of expressway 106. Movement trajectory 100 shows the path, which vehicle 102 traces. In this context, movement trajectory 100 is made up of straight sections, which connect points 118 to each other. Points 118 each represent a detected position of vehicle 102 at a specific time. The positions may be determined by a position determination system, such as GPS. The position determination system used here has an acquisition frequency. In this manner, a distance between points 118 is a function of a speed of vehicle 102. The more rapidly vehicle 102 moves, the greater are the distances between points 118.

Since the position determination system has an inaccuracy, points 118 represent a probable position of vehicle 102. At the specific acquisition time, an actual position of vehicle 102 may deviate more or less sharply from the probable position.

Movement trajectory 100 shows that in feeder area 116, vehicle 102 leaves the lane of entrance ramp 112 and switches to the lane of exit ramp 108. Outside of feeder area 116, vehicle 102 travels in a direction opposite to direction of travel 102, along exit ramp 108, in the direction of expressway 106, and consequently becomes wrong-way vehicle 102.

In order to detect the instance of wrong-way travel, movement trajectory 100 is compared to a model of junction 104 and/or to stored map data. If detected positions 118 indicate that vehicle 102 is traveling in a direction opposite to intended direction of travel 120, then other road users may be warned.

Since movement trajectory 100 is subject to uncertainty, the method waits for several detection time points, while vehicle 102 is already traveling in a direction opposite to direction of travel 120, in order to detect the instance of wrong-way travel with certainty. During this time, vehicle 102 has already traveled far in a direction opposite to direction of travel 120.

"Do Not Enter" signs 122, which refer to the one-way regulation of junction 104, are set up adjacent to exit ramp 108, on both sides. Signs 122 are oriented in such a manner, that they are clearly visible when driving in a direction opposite to direction of travel 120. The instance of wrong-way travel may also be recognized by an optical detection system on vehicle 102 and/or at the junction.

For example, in response to detection of a wrong-way driver 102, the person 102 driving in the wrong direction may be warned himself/herself via a display or acoustic indications. In the same way, other drivers in the vicinity of a wrong-way driver 102 may be warned, for example, via vehicle-to-vehicle communication or with the aid of mobile radio communication. In addition, other road users may be warned by variable-message traffic signs erected at the side of the road. Intervention in the engine control unit or brakes of the vehicle 102 traveling in the wrong direction may be undertaken, as well.

Analyses of wrong-way drivers 102 indicate that many instances of wrong-way travel are terminated within a distance of approximately 500 meters. If a person 102 driving in the wrong direction is detected and other road users in his/her vicinity are still supposed to be warned in a timely manner, then there is only a very small amount of time available. In particular, this becomes critical in the communication over a central server via mobile radio communication, since in this instance, a step of detecting, a step of identifying, a step of requesting, a step of collecting, and a step of presenting are executed in succession.

In the detecting step, a wrong-way driver 102 is detected. Depending on the method, the detection of wrong-way driver 102 may require several seconds. In particular, ample time is needed for detecting a vehicle position 118 supported by a digital map and GPS.

In the identifying step, vehicles in the vicinity of wrong-way driver 102, which are to be warned, are identified.

In the requesting step, the vehicles to be warned are prompted to set up a communication with the central server. For security reasons, it is not possible, as a rule, for the server to set up direct communication to the vehicle; the vehicles to be warned must do this.

In the steps of collecting and presenting, a warning message is collected from the server by the vehicles to be warned, and the warning message is presented on the HMI (human machine interface, for example, a display).

The reliable detection of a wrong-way driver 102 may be very time-consuming, in particular, when the detection is carried out with the aid of a digital map and position-finding supported by satellite. FIG. 1 shows a typical scenario along an expressway 106. Expressway 106 is shown in the region of an entrance 112 and an exit 108. A vehicle 102 is attempting to enter expressway 106. However, the driver takes the wrong entrance 108. His/her movement trajectory 100 is displayed. This may be ascertained in the vehicle with the aid of a satellite positioning system (GPS). Typical GPS receivers ascertain position 118 of vehicle 102 one time per second; the position of the vehicle being represented by points 118, which may be processed, for example, by connecting them with line segments, to form movement trajectory 100. This movement trajectory 100 may now be compared to a digital map, in which expressway ramps 108, 112 and directions of travel 120 permitted there are recorded. By comparing ascertained movement trajectory 100 to the digital map, it may be decided if a permitted ride or an instance of wrong-way travel is taking place.

In this method of ascertaining a wrong-way driver, the challenge is to decide unequivocally if an instance of wrong-way travel exists; the input signals, that is, vehicle positions 118, being able to be interfered with, for example, by multipath reception or atmospheric disturbances. It is also possible that the roadway geometry between entrance 112 and exit 108 is parallel or nearly parallel for a very long way, so that it may only be able to be unequivocally decided quite late, whether or not an instance of wrong-way travel is present. It is quite possible that six, seven or more GPS points 118 have to be analyzed one after the other, until it may be decided unequivocally whether or not an instance of wrong-way travel exists. In the case of GPS position retrieval at 1 Hz, 6 seconds, 7 seconds, or more seconds of valuable time may elapse in the process, which, up to now, have not been available for warning other road users.

Up to this point, a warning to other road users has taken place, as soon as vehicle 102 has reliably detected, that it was traveling in the wrong direction. Then it makes contact with a central server, for example, via mobile radio communication. This establishes if further vehicles are in the vicinity of wrong-way driver 102. If this is the case, then the further vehicle is prompted to set up a connection to the server, and there, collect information about the position of wrong-way driver 102 or a finished warning message. This may be presented to the driver of the vehicle via a suitable operator interface. The procedure of identifying vehicles in the vicinity of wrong-way driver 102, as well as the setting-up of communication with the vehicle, may also require several seconds, in individual cases, many seconds. If all of the times are added up, an instance of wrong-way travel may already come to an end without a driver being meaningfully warned of wrong-way driver 102 in a timely manner.

Figure 2:
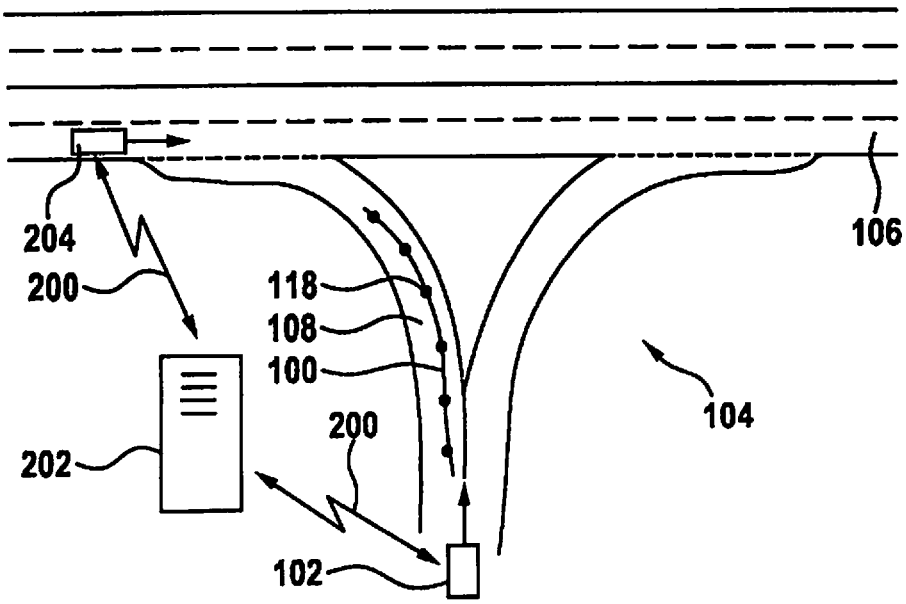
FIG. 2 shows a view of an advance detection of a possible instance of wrong-way travel, and of a setting-up of a communication path, according to an exemplary embodiment.

FIG. 2 shows a representation of an advance detection of a possible instance of wrong-way travel, and of a setting-up of a communication path 200, according to an exemplary embodiment. In this case, the instance of wrong-way travel is depicted at a junction 104, as is shown in FIG. 1. In this case, as well, a movement trajectory 100 of a vehicle 102 in a direction opposite to the direction of travel of an exit ramp 108 of junction 104 is shown.

Here, it is checked whether vehicle 102 could be traveling in the wrong direction. In this context, the possibility of the instance of wrong-way travel is already recognized, when vehicle 102 has come onto the lane of exit ramp 108 for a short time. At this time, however, it is not yet certain if an instance of wrong-way travel will actually occur.

If there is a possibility of wrong-way travel, communication path 200 is set up by communications infrastructure 202, but not yet used. In this context, communication path 200 is set up to road users 204, who would be put at risk by the potential instance of wrong-way travel. In the case represented, another vehicle 204 traveling on expressway 106 in the direction of junction 104 is acutely endangered. Communication path 200 is kept open until the possibility of wrong-way travel has passed.

If vehicle 102 is traveling on the exit ramp 108, through a plurality of detection time points 118, in a direction opposite to the direction of travel, then the wrong-way travel is detected with certainty. An information item regarding a wrong-way driver is then made available for endangered road users 204, via the communication path 200 already set up in a preventive manner, in order to warn endangered road users 204.

A parallel set-up of communication to a client 204 to be warned, prior to the completion of the detection of wrong-way driver 102, is put forward.

Using the approach presented here, an efficient method is described, which minimizes the complete "round-trip time" from the detection of a wrong-way driver, up to the presentation of the warning message in a vehicle 204 in the vicinity. The advantages of the approach presented here are, that the method steps of detecting, identifying, requesting, and collecting, described in FIG. 1, are partially executed in parallel. In this manner, the time-consuming steps of identifying and requesting may already proceed concurrently during a detection, still running, of a potential wrong-way driver 102. If, in the course of detection, it emerges that no instance of wrong-way travel is present after all, then the identifying and requesting steps started concurrently are aborted again, so that a warning of other road users 204 does not take place, even though communication 200 has already been set up with them.

In the approach presented here, the time-consuming steps are performed concurrently as much as possible. To that end, an "advance detection" is provided, which detects a wrong-way driver 102 as early as possible, for example, after one to two seconds, with the first GPS positions 118 of vehicle 102, even though the detection cannot yet take place reliably.

Figure 3:
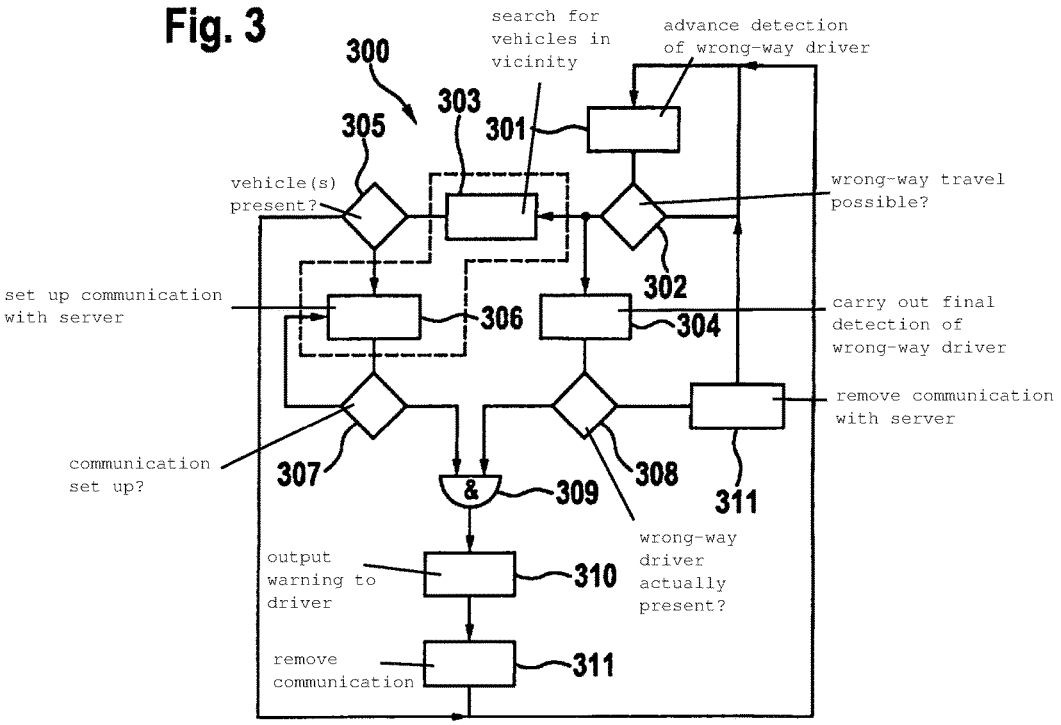
FIG. 3 shows a flow chart of a method for warning other road users, according to an exemplary embodiment.

FIG. 3 shows a flow chart of a method 300 for warning other road users, according to an exemplary embodiment. Using method 300, the other road users are warned when a vehicle is traveling in the wrong direction.

In a functional block 301, advance detection of a wrong-way driver takes place. In a decision block 302 positioned downstream from advance detection 301, a result of advance detection 301 is evaluated as to whether an instance of wrong-way travel is possible.

If wrong-way travel is not possible, then advance detection 301 is carried out again. If an instance of wrong-way travel is possible, then, in a functional block 303 situated downstream from decision block 302, a search is made for vehicles in the vicinity. Simultaneously to that, a final detection of a wrong-way driver is carried out, as well, in a functional block 304 situated downstream from decision block 302. In a decision block 305 situated downstream from vehicle search 303, a result of vehicle search 303 is evaluated as to whether vehicles are present.

If no vehicles are present, then advance detection 301 is performed again. If at least one vehicle is present, then, in a functional block 306 situated downstream from decision block 305, communication with a server is set up. In a decision block 307 downstream from the setting-up of communication 306, it is checked if the communication has been set up. If the communication is not set up, then the setting-up of communication 306 is directly carried out once more.

In a decision block 308 situated downstream from final wrong-way driver detection 304, a result of final wrong-way driver detection 304 is checked as to whether a wrong-way driver is actually present. If a wrong-way driver is present, and if the communication is set up, the results are logically combined in a logic operations block 309, in this case, with the aid of an AND operation; and in a functional block 310, a warning is outputted to a driver. Subsequently, in a functional block 311, the communication with the server is removed. In the same way, the removal of communication 311 is carried out, when an actual instance of wrong-way travel has not been detected. After the removal of communication 311, advance detection 301 is carried out once more.

In one exemplary embodiment, method 300 only includes advance detection step 301, detection step 304, setting-up step 306, and provision step 310. In advance detection step 301, a potential of a possible instance of wrong-way travel of the vehicle is detected in advance. If the wrong-way travel potential is greater than an advance warning value, then, in setting-up step 306, a communication path to at least one road user put at risk by the wrong-way travel is set up. In the meantime, the instance of wrong-way travel of the vehicle is detected in detecting step 304. If the possible instance of wrong-way travel is detected as an actual instance of wrong-way travel, then, in provision step 310, an information item about a wrong-way driver is provided for the endangered road user via the communication path set up. Consequently, in step 306, the communication path may already be set up temporally before the actual detection of the wrong-way travel, which occurred in step 304. The advantage of this is that the communication path is already set up, when the wrong-way travel is detected.

Advance detection step 301 occurs cyclically. If the wrong-way travel potential is less than the advance warning value, then advance detection step 301 is executed once more.

In setting-up step 306, in a partial step 303 of searching, road users put at risk by the possible instance of wrong-way travel are sought. If endangered road users are found, then the communication path to these road users is set up. In this context, setting-up 306 is executed cyclically. If communication path is not set up reliably, then setting-up 306 is initiated once more.

If an instance of wrong-way travel is not detected in detecting step 304, then, in a removal step 311, the communication path is removed again.

If the communication path is set up and an instance of wrong-way travel is detected, then the other road users are warned via the communication path. Subsequently, the communication path is removed again in removal step 311.

In the flowchart of the method 300 presented here, an "advance detection" 301 of all participating vehicles takes place constantly. If advance detection 301 arrives at the result, that a possible instance of wrong-way travel exists, which is also possible after a short period of time, with an acceptable level of uncertainty, then a decision block 302 starts search 303 for vehicles in the vicinity. In this context, wrong-way driver detection 304 continues until it is certain, whether or not an instance of wrong-way travel is present. If vehicles are located in the vicinity of the potential wrong-way driver, then the setting-up of communication 306 to the server, of the vehicles situated in the vicinity, is initiated concurrently via a further decision block 305. If the setting-up of communication 306 has occurred, then the communication is maintained until the final wrong-way travel decision has been made. If this turns out to be positive, then a warning 310 is supplied to the vehicles in the vicinity, that is, to their drivers. Subsequently, the communication may be removed again, and the method is finished. If wrong-way travel is not detected, then the driver in the vicinity is not warned, and the communication of this driver with the server is removed, as well, and advance detection 301 for a potential instance of wrong-way travel starts from the beginning.

According to one exemplary embodiment, advance detection 301 of a potential wrong-way driver is separated from final detection 304 in conjunction with an immediate setting-up of communication 306 with vehicles in the vicinity, while final detection 304 is not yet completed.

Using this method 300, communication may possibly be set up with drivers in the vicinity of a potential wrong-way driver, although no warning is given. However, the advantage is a warning that is, as a rule, considerably earlier, since the communication channel to the drivers in the vicinity of a wrong-way driver may already be set up completely, when the instance of wrong-way travel is finally detected. Since mobile communication today is, as a rule, very inexpensive, the advantage of a considerably earlier warning of a person driving in the wrong direction outweighs the communication costs that are possibly increased due to the communication path being set up earlier.

In one exemplary embodiment, both advance detection 301 and final wrong-way driver detection 304 are carried out locally in the vehicle of the potential wrong-way driver.

In one exemplary embodiment, the two tasks 301, 304 are carried out on the central server.

In a further refinement, one of the two tasks 301, 304 is executed in the vehicle, and, in each instance, the other is executed on the central server.

Advance detection 301 and final detection 304 may be based on the same method, for example, on the comparison of a GPS movement trajectory to a digital map; advance detection 301 including only one to a few GPS points, but final detection 304 including several GPS points.

Advance detection 301 and final detection 304 may be based on different detection methods, for example, on a video-based detection of a "Do Not Enter" traffic sign and a comparison of a GPS trajectory to a digital map.

Since, as a rule, a position determination based on GPS is only possible at a frequency of 1 Hz, then, in one exemplary embodiment, the position determination is supplemented by inertial sensor technology. To that end, acceleration sensors and/or rotation-rate sensors are used. In addition, a vehicle motion model may be used, for example, in combination with a Kalman filter, in order to resolve the movement trajectory even more highly between the individual GPS position points, for example, at a frequency of 10 Hz or even 100 Hz. This high-resolution movement trajectory may be utilized for both advance detection 301 and final detection 304.

In one exemplary embodiment, the movement trajectory based on GPS is filtered, for example, using low-pass filtering, and extrapolated into the future with the aid of inertial sensor technology, and used for advance detection 301. In this manner, very early advance detection 301 of a potential wrong-way driver may take place.

If a smart phone is used for detecting 304 a person driving in the wrong direction, then the server may calibrate its inertial sensors through constant monitoring of the sensors.

In one expanded exemplary embodiment, not only is there a warning 310 to another driver of a wrong-way driver, but also further vehicle functions are activated automatically. For example, an evidence camera is activated in both the vehicle of the wrong-way driver and the vehicle of the driver to be warned. As the communication to the server may be set up preventively, a function such as an accident camera may also be activated preventively, in order to document the event.

Figure 4:
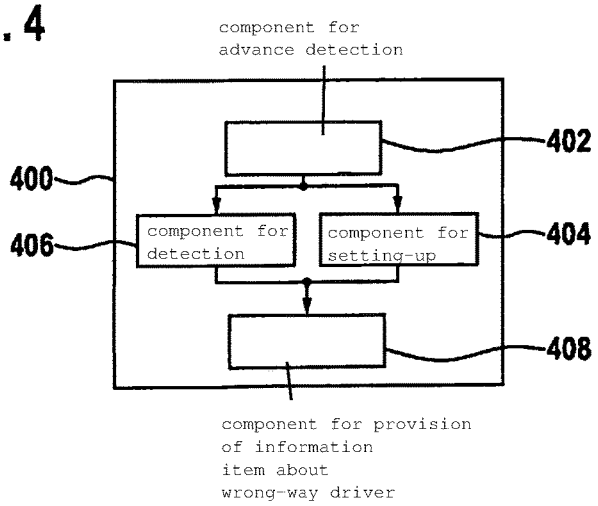
FIG. 4 shows a block diagram of a system for warning other road users, according to an exemplary embodiment.

FIG. 4 shows a block diagram of a system 400 for warning other road users, according to an exemplary embodiment. A method for warning other road users in response to a vehicle traveling in the wrong direction, as is described, for example, in FIG. 3, may be implemented on system 400. System 400 includes a component 402 for advance detection, a component 404 for setting-up, a component 406 for detection, and a component 408 for provision. Component 402 for advance detection is configured to detect a wrong-way travel potential of a possible instance of wrong-way travel of the vehicle in advance. Component 404 for setting-up is configured to set up a communication path to at least one road user put at risk by the instance of wrong-way travel, if the wrong-way travel potential is greater than an advance warning value. Component 406 for detection is configured to detect the instance of wrong-way travel of the vehicle. Component 408 for provision is configured to provide an information item about a wrong-way driver for the endangered road user via the communication path set up, if the possible instance of wrong-way travel is detected as an actual instance of wrong-way travel.

If an exemplary embodiment includes an "and/or" conjunction between a first feature and a second feature, then this is to be understood to mean that according to one specific embodiment, the exemplary embodiment includes both the first feature and the second feature, and according to a further specific embodiment, the exemplary embodiment includes either only the first feature or only the second feature.

What is claimed is:

1. A method for warning other road users in response to a vehicle traveling in a wrong direction, the method comprising:

advance detecting of a wrong-way travel potential of a possible instance of wrong-way travel of the vehicle;

setting up a communication path to at least one road user endangered by the instance of wrong-way travel, if the wrong-way travel potential is greater than an advance warning value, wherein the communication path is kept open until there is no longer a probability of wrong-the way travel, and wherein if there is a possibility of wrong-way travel, the communication path is set up by a communications infrastructure, but it is not yet used;

detecting the instance of wrong-way travel of the vehicle;

providing an information item about the instance of wrong-way travel for the endangered road user via the communication path set up, if the possible instance of wrong-way travel is detected as an actual instance of wrong-way travel; and removing the communication path if at least one of: (i) the wrong-way travel potential is less than the advance warning value, and (ii) no actual instance of wrong-way travel is detected.

2. The method as recited in claim 1, wherein in at least one of the advance detecting and the detecting the instance, at least one of the wrong-way travel potential and the actual instance of wrong-way travel, respectfully, are determined, using a comparison between (i) at least one of an ascertained vehicle position and a movement trajectory of the vehicle, and (ii) map data.

3. The method as recited in claim 2, wherein in at least one of the advance detecting and the detecting the instance, the movement trajectory is predicted into the future, using at least one filter.

4. The method as recited in claim 2, wherein in at least one of the advance detecting and the detecting the instance, the movement trajectory is determined, using at least one of a vehicle motion model of the vehicle and an inertial sensor system of the vehicle.

5. The method as recited in claim 2, wherein in at least one of the advance detecting and the detecting the instance, at least one of the wrong-way travel potential and the actual instance of wrong-way travel, respectively, are determined, using a surround sensor system of the vehicle.

6. The method as recited in claim 1, wherein in the advance detecting and the detecting the instance, the wrong-way travel potential and the actual instance of wrong-way travel, respectively, are determined, using the same detection method.

7. The method recited in claim 1, wherein in the setting-up, a recording is also started, if the wrong-way travel potential is greater than the advance warning value.

8. A system for warning other road users in response to a vehicle traveling in a wrong direction, a system arrangement configured to perform the following:

detecting in advance a wrong-way travel potential of a possible instance of wrong-way travel of the vehicle;

setting up a communication path to at least one road user endangered by the instance of wrong-way travel, if the wrong-way travel potential is greater than an advance warning value, wherein the communication path is kept open until there is no longer a probability of wrong-the way travel, and wherein if there is a possibility of wrong-way travel, the communication path is set up by a communications infrastructure, but it is not yet used;

detecting the instance of wrong-way travel of the vehicle;

providing an information item about the instance of wrong-way travel for the endangered road user via the communication path set up, if the possible instance of wrong-way travel is detected as an actual instance of wrong-way travel; and removing the communication path if at least one of: (i) the wrong-way travel potential is less than the advance warning value, and (ii) no actual instance of wrong-way travel is detected.

9. A non-transitory machine-readable storage medium having a computer program, which is executable by a processor, comprising:

a program code arrangement having program code for warning other road users in response to a vehicle traveling in a wrong direction, by performing the following:

advance detecting, via the processor, of a wrong-way travel potential of a possible instance of wrong-way travel of the vehicle;

setting up, via the processor, a communication path to at least one road user endangered by the instance of wrong-way travel, if the wrong-way travel potential is greater than an advance warning value, wherein the communication path is kept open until there is no longer a probability of wrong-the way travel, and wherein if there is a possibility of wrong-way travel, the communication path is set up by a communications infrastructure, but it is not yet used;

detecting, via the processor, the instance of wrong-way travel of the vehicle;

providing, via the processor, an information item about the instance of wrong-way travel for the endangered road user via the communication path set up, if the possible instance of wrong-way travel is detected as an actual instance of wrong-way travel; and removing the communication path if at least one of: (i) the wrong-way travel potential is less than the advance warning value, and (ii) no actual instance of wrong-way travel is detected.

* * * * *